US005974752A

United States Patent [19]

Watson

[11] Patent Number: 5,974,752

[45] Date of Patent: Nov. 2, 1999

[54] SYSTEM FOR JOINTING PANELS

[76] Inventor: William Black Watson, 32 Newmill Road, Dunlop, Avrshire, United Kingdom, KA3 4BA

[21] Appl. No.: 08/913,927

[22] PCT Filed: Mar. 22, 1996

[86] PCT No.: PCT/GB96/00701

§ 371 Date: Sep. 19, 1997

§ 102(e) Date: Sep. 19, 1997

[87] PCT Pub. No.: WO96/29486

PCT Pub. Date: Sep. 26, 1996

[30] Foreign Application Priority Data

| | | | |
|---|---|---|---|
| Mar. 22, 1995 | [GB] | United Kingdom | 9505811 |
| Jun. 30, 1995 | [GB] | United Kingdom | 9513338 |
| Aug. 9, 1995 | [GB] | United Kingdom | 9516319 |
| Dec. 16, 1995 | [GB] | United Kingdom | 9525793 |

[51] Int. Cl.[6] ..... E04D 1/36

[52] U.S. Cl. ..... 52/466; 52/461; 52/465; 52/199

[58] Field of Search ..... 52/461–466, 198, 52/199, 468–469, 95

[56] References Cited

U.S. PATENT DOCUMENTS

| | | | |
|---|---|---|---|
| 4,045,928 | 9/1977 | Malott | 52/199 |
| 4,271,651 | 6/1981 | Sorrells | 52/460 |
| 4,590,730 | 5/1986 | Blendick | 52/461 |

*Primary Examiner*—Beth Aubrey
*Attorney, Agent, or Firm*—Flehr Hohbach Test Albritton & Herbert LLP

[57] ABSTRACT

A system for joining a first panel (2) and a second panel (3) overlying a support structure (4) comprising a retaining member (8) fixable to the support structure (4) and having a portion adapted to retain a side (6) of said first panel (2) and a cap member (9) configured substantially to enclose said retaining member (8), wherein said cap member (9) has an inwardly directed projection (14, 15) for retaining the cap member and wherein said cap member (9) is perforated.

16 Claims, 3 Drawing Sheets

SYSTEM FOR JOINTING PANELS

BACKGROUND OF THE INVENTION

This invention relates to a system for jointing panels, and in particular for jointing metal panels to form a sheet for the roofing or cladding of buildings.

Sheet coverings are in widespread use on buildings, particularly for roofing. Narrow panels are laid parallel to the slope of a roof on top of a timber deck which provides support. These panels are then joined to form a sheet. It is necessary to ventilate the roof space and the underside of the covering to the atmosphere to avoid condensation.

However since this form of roofing was introduced, the need to conserve energy has been recognised. To this end roof structures are now provided with insulation, and gratuitous air movements eliminated from roof spaces. This reduction of the natural ventilation of buildings has the concomitant effect of increasing condensation therein, the evaporation of which is precluded by the necessary imperviousness to vapour of the materials of which the sheet coverings are formed.

In addition, although sheet coverings are adequate in most weather conditions, their performance in severe storms is unpredictable. For example, when subjected to negative wind loads, pressure differences across a sheet roof covering will cause it to deflect upwards.

Thus two serious problems with sheet roofing, limiting both performance and lifespan, are condensation and wind damage by suction. The present invention addresses both problems by providing means simultaneously to ventilate the underside of roofs and prevent the upward deflection of roofing panels.

U.S. Pat. No. 2,635,332 describes a system for jointing a first panel and a second panel overlying a support structure comprising a retaining member fixable to the support structure and having a first portion adapted to retain a side of said first panel and a second portion adapted to retain a side of said second panel; and a cap having a cross-section of generally inverted U-shape and configured substantially to enclose said retaining member, wherein said cap has inwardly directed projections from the sides of the cap forming the vertical legs of the U-shape.

DE-A-3 741 379 and FR-A-1 112 077 also show similar systems for jointing a first panel and a second panel overlying a support structure.

According to a first aspect of the present invention there is provided a system for jointing a first panel and a second panel overlying a support structure comprising a retaining member fixable to the support structure and having a first portion adapted to retain a side of said first panel and a second portion adapted to retain a side of said second panel; and a cap having a cross-section of generally inverted U-shape and configured substantially to enclose said retaining member; characterised in that said cap is configured to permit the circulation of air and preclude the entry of water or the like, from above the system.

Preferably said cap has projections from the sides of the cap forming the vertical legs of the U-shape, said projections being perforated.

Preferably said system is for jointing a first metal panel and a second metal panel.

Preferably the cap is held in place by cooperation with at least one retaining member.

Preferably the cap is configured to 'click-fit' said at least one retaining member.

Preferably said projections are deformable to engage a retaining member to achieve said 'click-fit'.

Preferably said retaining member is in the form of a generally M-shaped clip. Said clip may be made from stainless steel. More preferably said clip is made from 3 mm stainless steel.

Preferably the legs of said clip are shorter than the sides of said panels which they retain, in order that there is a gap between the termination of a leg and the face of a panel.

Further according to the present invention there is provided a roofing system comprising:

metal panels with upturned sides running substantially parallel;

a support structure;

a retaining member fixable to the support structure and adapted to contain the sides of adjacent panels; and a cap having a cross-section of generally inverted U-shape and configured substantially to enclose said retaining member;

characterised in that said cap has projections from the sides of the cap forming the vertical legs of the U-shape, said projections being perforated.

Preferably said metal panels lie orthogonal to the support structure thereby defining a cross grid.

Further according to the present invention there is provided a cap for use in the system of claim 1 characterised in that said cap is of cross-section of generally inverted U-shape and has projections from the sides of the cap forming the vertical legs of the U-shape, said projections being perforated.

BRIEF DESCRIPTION OF THE DRAWINGS

Embodiments of the present invention will now be described by way of example only, with reference to the accompanying drawings in which.

DETAILED DESCRIPTION OF THE INVENTION

Figure 1:
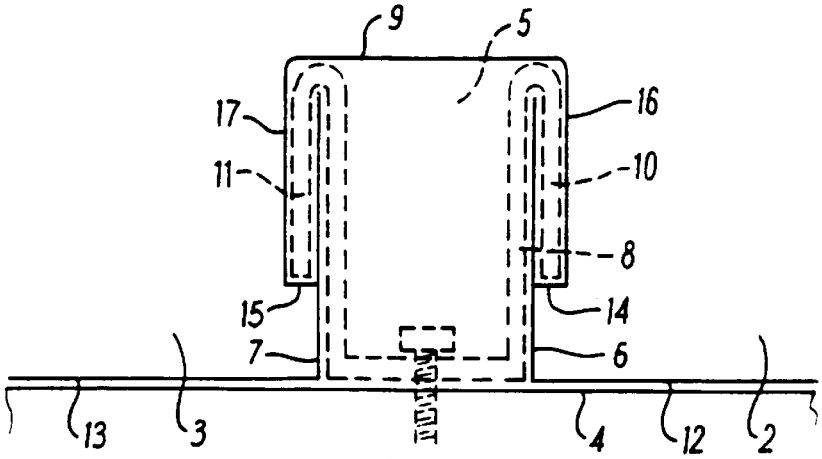
FIG. 1 is a section of a system for jointing metal panels in accordance with the present invention.
Figure 2:
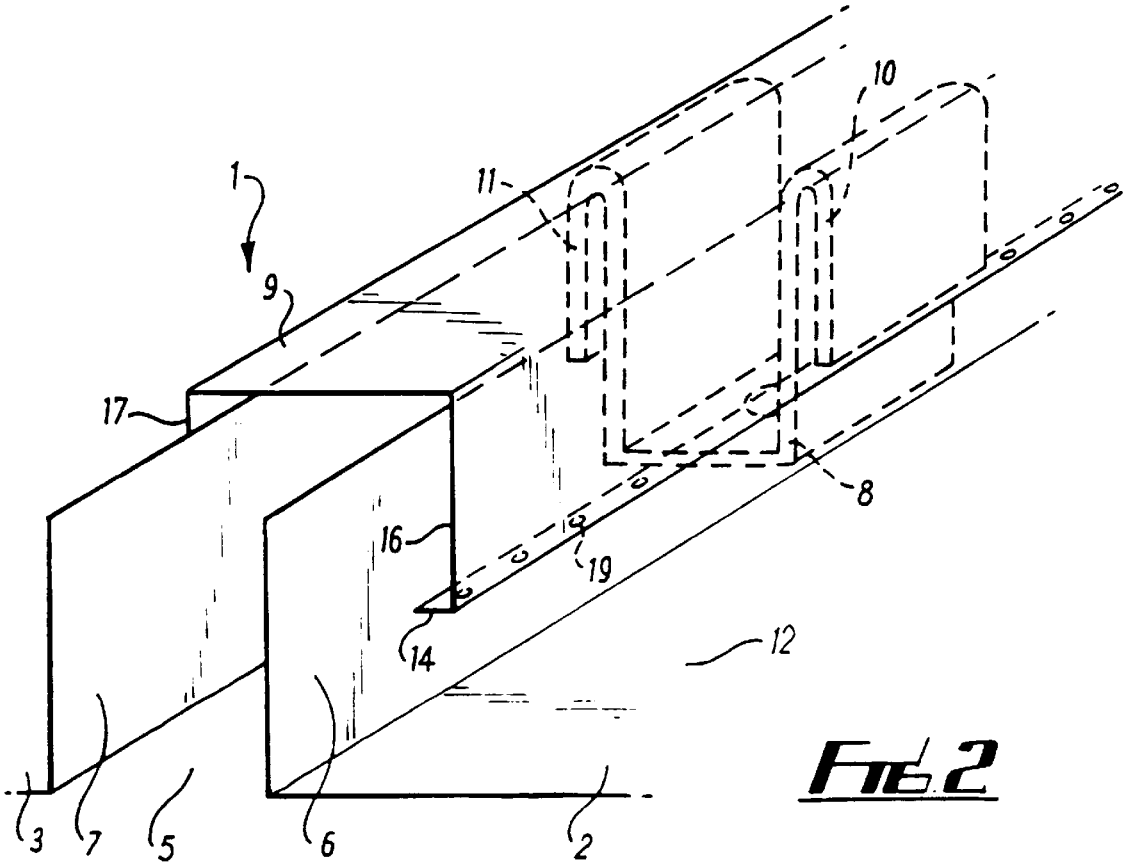
FIG. 2 is an isometric view of the system for jointing metal panels in accordance with the present invention.
Figure 3:
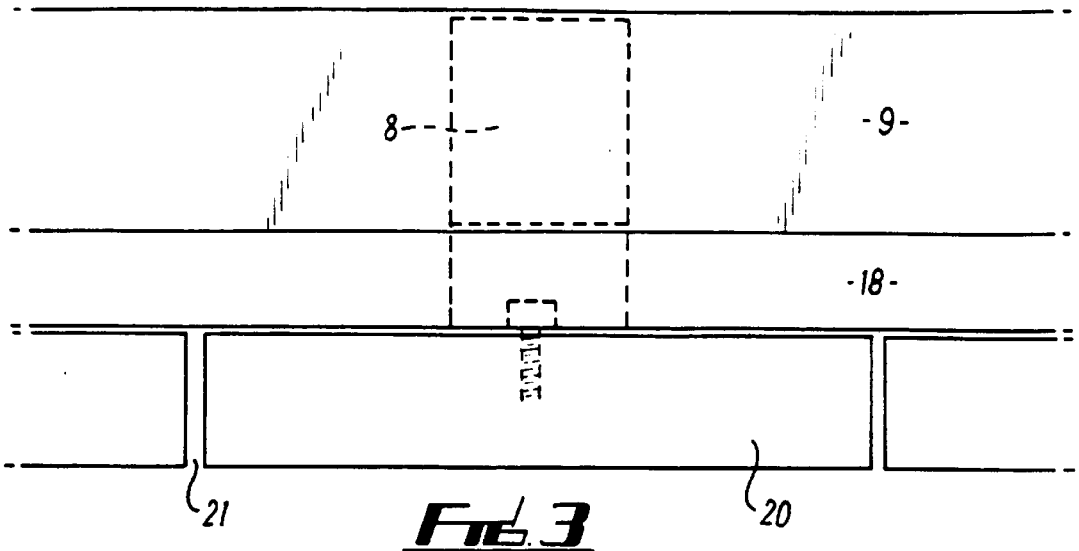
FIG. 3 is a side elevation of the system for jointing metal panels in accordance with the present invention.
Figure 4:
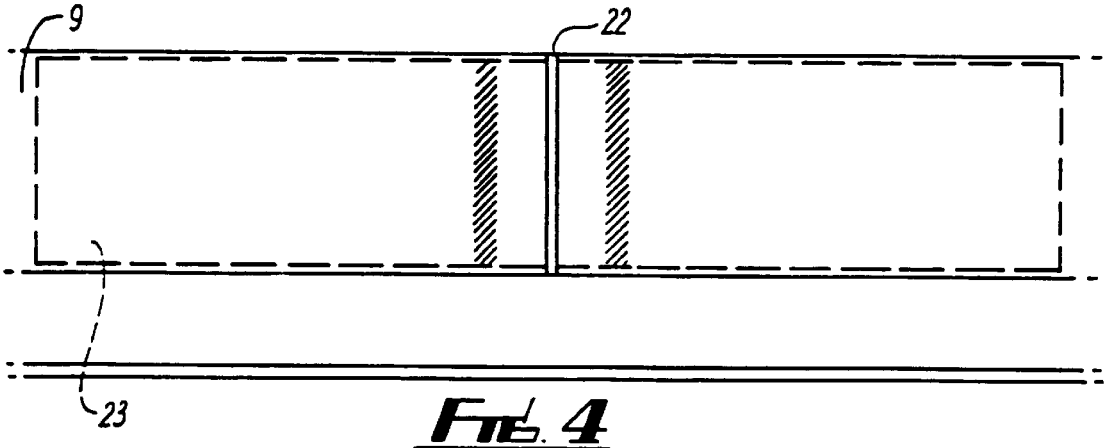
FIG. 4 is a side elevation of the system for jointing metal panels showing a sleeve joint piece.
Figure 5:
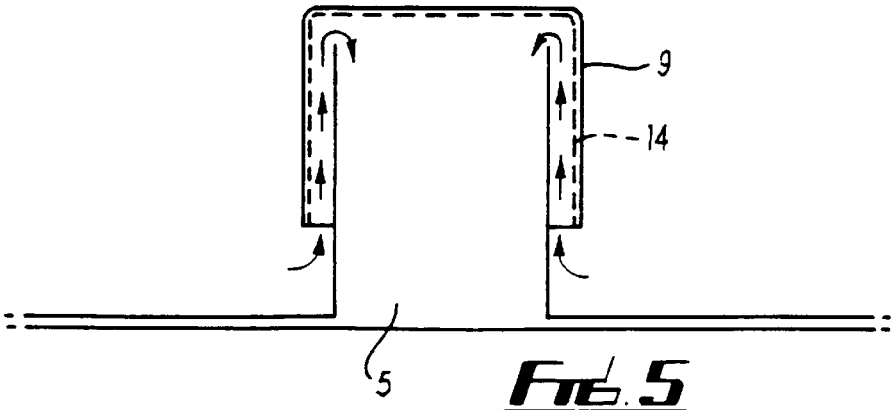
FIG. 5 is a section through the cap showing the joint piece.
Figure 6:
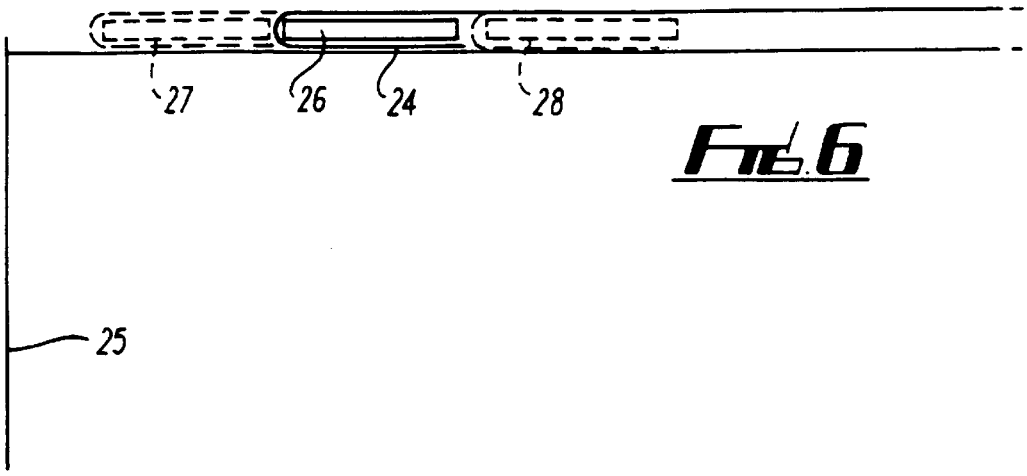
FIG. 6 is a section through an edge of a panel showing a metal bar in accordance with the present invention.
Figure 7:
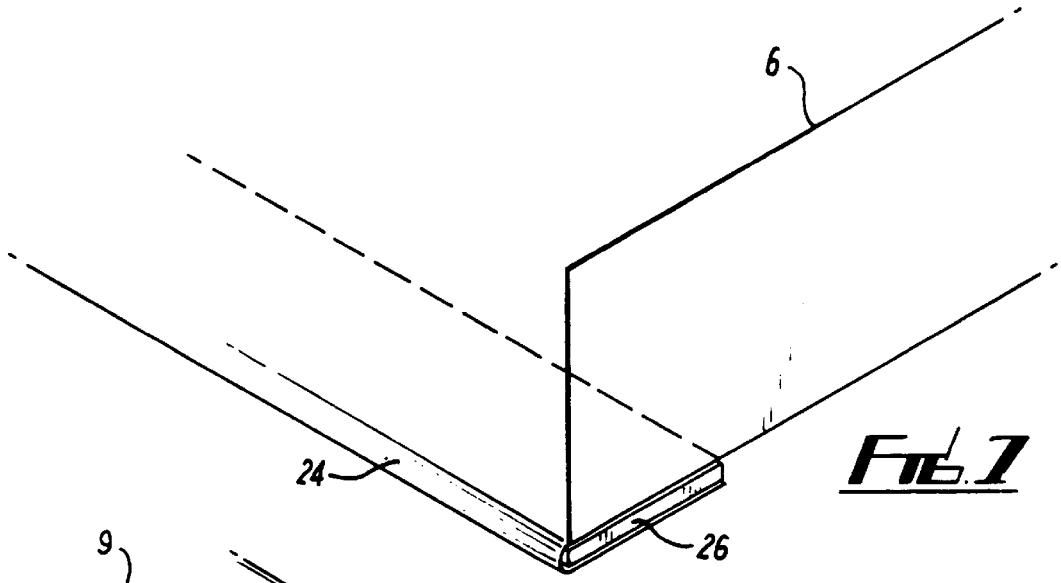
FIG. 7 is an isometric view of the edge of the panel showing the metal bar.
Figure 8:
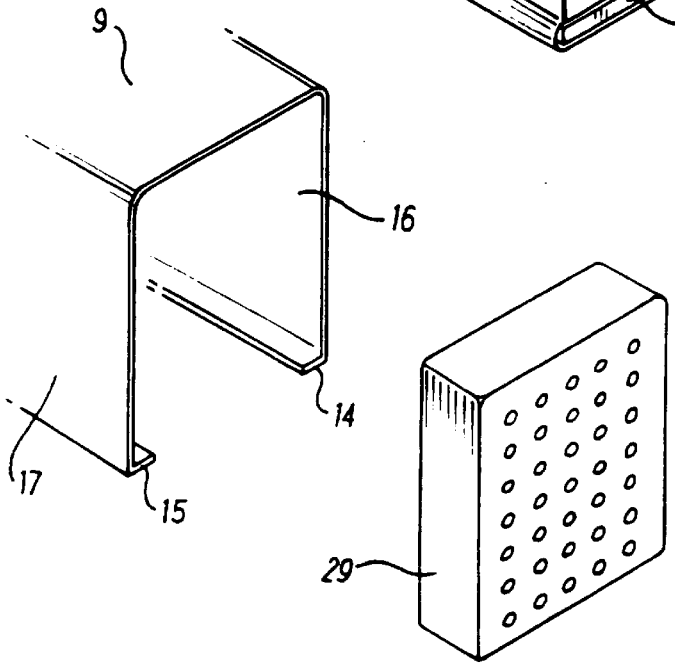
FIG. 8 is an isometric of a closing piece in accordance with the present invention.

Referring to the drawings, a roofing sheet generally designated 1 is constructed from strips of metal upturned along the length of each side to form roofing panels 2,3. To form the sheet, panels 2,3 are placed alongside one another on a support deck 4 beneath which there is an air gap, then insulation on top of a vapour barrier. A channel 5 is left between adjacent upturns 6,7 of panels 2,3. Jointing of adjacent panels 2,3 is achieved by the use of a system of cooperating clips 8 and caps 9.

M-shaped clips 8 made of 3 mm stainless steel are hooked over the edges of the adjacent upturns 6,7 at regular intervals and fixed into the support deck 4 in the channel 5 between panels 2,3. These clips 8 act as spacers between panels 2,3. The legs 10,11 of the clip terminate just short of the face 12,13 of a panel 2,3. Thus, no water is drawn up between a clip 8 and a panel upturn 6,7 by capillary action.

Inverted U-shaped caps 9 are then fitted over channels 5. These caps 9 have projections 14,15 from the vertical legs 16,17 which are snap-fixed under the legs 10,11 of the clips 9 to achieve a 'click-fit'. The precise sizing of the clips 8 ensures a constant air gap between a cap 9 and a panel 2,3. A gap 18 of 1–2 mm is left between a projection 14,15 of a cap and the face 12,13 of a panel 2,3 for ventilation These caps 9 may have perforations 19 in the projections 14,15. The perforations 19 are alternative means for the circulation of air for ventilation.

Plentiful joints distributed throughout the roofing sheet 1 ensure even and predictable ventilation of all areas of a roof regardless of its pitch or length. Since ventilation coincides with the joints which are a maximum of 600 mm apart, this ensures that no area is unventilated.

The clips 8 are made from stainless steel in order that they may be used with any metal.

The support deck 5 is formed from square-edged boarding 20 with gaps 21 between. The metal panels 2,3 are placed so that they run orthogonal to the boarding 20 of the support deck 5 in order that a cross grid of ventilation is formed between the boards. This means a gap in the roof space is not essential, allowing use of a warm roof construction.

The support deck 5 may alternatively be formed from plywood or its like. In that case, prior to the cap 9 being positioned, holes are drilled in the deck 5 for circulation of air.

The gap 18 between the projections 14,15 from the cap 9 and the faces 12,13 of the panels 2,3, or the perforations 19 in the caps 9 further ensure that atmospheric pressure is equalised under the sheeting 1, thus preventing each panel 2,3 from being subject to upward deflection regardless of wind conditions. This has the additional benefit that, since the panels 2,3 are not subject to cyclic stress, metal fatigue will not occur.

If these gaps 18 or perforations 19 should become blocked, when a panel 2,3 is subject to wind suction the length of the legs 10,11 of the clips 8 lowers the fulcrum point of the panel 2,3 from the top of an upturn 6,7 to the bottom so that the panel 2,3 may deflect upwards across its width without disengaging from the clip 8.

Cap joints 22 are formed by the insertion of a sleeve 23 along a channel 5. The sleeve 23 is of external dimensions equivalent to the internal dimensions of the cap 9, but with no projections. Any space between cap 9 and sleeve 23 is filled with a silicone sealant to prevent water entering the roof by capillary action. Alternatively the sleeve 23 may be soldered to one or both ends of the cap 9 making a metal-to-metal connection.

The roofing panels 2,3 are able to expand and contract when subject to heat or cold. Traditionally an edge of a panel is held by hooking it over an edge trim 25 of a roof or by welting it into a continuous tie strip fixed to the edge trim 25, which means that panels 2,3 are restricted in length by the amount of expansion possible without disengaging. Thus, in order that there is no restriction on panel 2,3 length, a bar 26 is inserted into a pre-formed panel edge 24. This bar, which extends between the upturns 6,7 stiffens the edge 24 to resist wind uplift and removes the need for the panel 2,3 to be hooked over or welted into a roof edge trim 25. This allows its unrestricted expansion 27 and contraction 28.

An additional feature of the cap 9 may be incorporated at the eaves of a roof. A perforated closing piece 29 may be provided to assist ventilation.

I claim:

1. A system for joining a first panel (2) and a second panel (3) overlying a support structure (4) comprising:

a retaining member (8) fixable to the support structure (4) and having a portion adapted to retain sides (6) of said panels (2); and a cap member (9) configured substantially to enclose said retaining member (8);

wherein said cap member (9) has an inwardly directed projection (14,15) for retaining the cap member;

and wherein said cap member (9) is perforated.

2. The system as claimed in claim 1 wherein said projection (14,15) is perforated.

3. The system as claimed in claim 1 wherein said cap member (9) has a cross-section of generally inverted U-shape.

4. The system as claimed in claim 1 for joining a first metal panel (2) and a second metal panel (3).

5. The system as claimed in claim 1 wherein the cap member (9) is held in place by cooperation with at least one of said retaining member (8).

6. The system as claimed in claim 5 wherein the cap (9) is configured to 'click-fit' said at least one retaining member (8).

7. The system as claimed in claim 6 wherein said projection (14,15) is deformable to engage said retaining member (8) to achieve said 'click-fit'.

8. The system as claimed in claim 1 wherein the retaining member (8) is in the form of a generally M-shaped clip with legs.

9. The system as claimed in claim 8 wherein said clip (8) is made from stainless steel.

10. The system as claimed in claim 9 wherein said clip (8) is made from 3 mm stainless steel.

11. The system as claimed in claim 10 wherein the legs (10,11) of said clip (8) are shorter than the sides (6,7) of said panels (2,3) which they retain, in order that there is a gap between the termination of the legs and the panels (2,3).

12. A cap member (9) for use in the system of claim 1, the cap member including sides and characterized in that said cap member (9) is of cross-section of generally inverted U-shape with vertical legs (16,17) and has inward projections (14,15) from the vertical legs, said projections being perforated.

13. A roofing system comprising:

side-by-side metal panels (2,3) with upturned sides (6,7) running substantially parallel;

a support structure (4);

a retaining member (8) adapted to be fixed to the support structure (4) and adapted to retain the sides (6,7) of adjacent metal panels (2,3); and a cap member (9) configured substantially to enclose said retaining member (8);

wherein said cap member (8) has an inwardly directed projection (14,15) for retaining the cap member (9) against said retaining member;

and wherein said cap member (9) is perforated.

14. The roofing system as claimed in claim 13 wherein said projection (14,15) is perforated.

15. The roofing system as claimed in claim 13 wherein said cap member (9) has a cross-section of generally inverted U-shape.

16. The roofing system as claimed in claim 13 wherein said metal panels (2,3) lie orthogonal to the support structure (4) thereby defining a cross-grid.

* * * * *